US007631723B2

(12) United States Patent
Ono et al.

(10) Patent No.: US 7,631,723 B2
(45) Date of Patent: Dec. 15, 2009

(54) LOUDSPEAKER DIAPHRAGM AND METHOD FOR MANUFACTURING THE SAME

(75) Inventors: Yushi Ono, Neyagawa (JP); Toshihide Inoue, Neyagawa (JP)

(73) Assignee: Onkyo Corporation, Osaka (JP)

( * ) Notice: Subject to any disclaimer, the term of this patent is extended or adjusted under 35 U.S.C. 154(b) by 371 days.

(21) Appl. No.: 10/730,162

(22) Filed: Dec. 8, 2003

(65) Prior Publication Data

US 2004/0112672 A1 Jun. 17, 2004

(30) Foreign Application Priority Data

Dec. 9, 2002 (JP) ..... 2002-356281
Sep. 25, 2003 (JP) ..... 2003-332798

(51) Int. Cl.
*G10K 13/00* (2006.01)

(52) U.S. Cl. ..... 181/169; 181/167; 181/170; 381/426; 381/428; 29/594; 29/609.1

(58) Field of Classification Search ..... 181/167, 181/168, 169, 170; 381/426, 427, 428; 29/594, 29/609.1
See application file for complete search history.

(56) References Cited

U.S. PATENT DOCUMENTS 2,873,813 A 2/1959 Haerther, Jr. et al.
4,076,098 A * 2/1978 Ward ..... 181/170
4,078,160 A * 3/1978 Bost ..... 381/190
4,674,592 A 6/1987 Aoki et al.
5,055,341 A * 10/1991 Yamaji et al. ..... 428/174
5,744,761 A * 4/1998 Ogura et al. ..... 181/167
6,378,649 B1 * 4/2002 Inoue et al. ..... 181/167
7,123,738 B1 * 10/2006 Mizone et al. ..... 381/406
2002/0027997 A1 * 3/2002 Watanabe et al. ..... 381/354
2002/0045040 A1 * 4/2002 Kanada et al. ..... 428/305.5
2003/0212251 A1 11/2003 Nakaie et al.
2005/0051380 A1 3/2005 Takayama et al.

FOREIGN PATENT DOCUMENTS

EP 0 303 173 A1 2/1989

(Continued)

OTHER PUBLICATIONS

Merriam-Webster Online Dictionary, Definition of monofilament, http://www.merriam-webster.com/dictionary/monofilament.*

(Continued)

*Primary Examiner*—Jeffrey Donels
*Assistant Examiner*—Jeremy Luks
(74) *Attorney, Agent, or Firm*—The Webb Law Firm

(57) ABSTRACT

A loudspeaker diaphragm having light weight and an excellent balance between a rigidity and an internal loss, and a simple and inexpensive method for manufacturing such a diaphragm are provided. The loudspeaker diaphragm includes a base layer having a woven fabric of a polyethylene naphthalate fiber impregnated with a thermosetting resin, and optionally a thermoplastic resin layer and/or a thermoplastic elastomer layer. The polyethylene naphthalate fiber is preferably an untwisted fiber. A fiber/resin weight ratio in the base layer is preferably in the range of 60/40 to 80/20. Preferably, the thermoplastic resin layer has a finely foamed structure and an average diameter of a cell in the finely foamed structure is 10 to 60 μm.

19 Claims, 8 Drawing Sheets

FOREIGN PATENT DOCUMENTS

| | | | | |
|---|---|---|---|---|
| EP | 508596 | A1 | * | 10/1992 |
| EP | 0 632 675 | A1 | | 1/1995 |
| JP | 63187900 | A | * | 8/1988 |
| JP | 01067099 | A | * | 3/1989 |
| JP | 01-270494 | A | | 10/1989 |
| JP | 08337666 | A | * | 12/1996 |
| JP | 63-131699 | A | | 6/1998 |
| JP | 11266493 | A | * | 9/1999 |
| JP | 2003-204593 | A | | 7/2003 |
| JP | 2005-080098 | A | | 3/2005 |
| WO | WO 01/46217 | A2 | | 6/2001 |

OTHER PUBLICATIONS

Patent Abstracts of Japan, Publication No. 64-067099, published Mar. 13, 1989, Inventors: Okuzawa Kazuro et al., "Diaphragm for Acoustic Equipment".

Patent Abstracts of Japan, Publication No. 06-181598, published Jun. 28, 1994, Inventors: Sasaki Matsuhiro et al., "Diaphragm for Speaker and Production Thereof".

Patent Abstracts of Japan, Patent No. 3135482, registered Dec. 1, 2000, Inventors: Sato et al., "Speaker Diaphragm Made of Injection Foamed Mold".

Patent Abstracts of Japan, Publication No. 11-080408, published Mar. 26, 1999, Inventors: Itou Takako et al., "Preparation of Resin Foam".

Patent Abstracts of Japan, Publication No. 2001-204094, published Jul. 27, 2001, Inventors: Morimoto Hiroyuki et al., "Speaker".

Patent Abstracts of Japan, Publication No. 03-201795, published Sep. 3, 1991, Inventors: Mae Yutaka et al., "Diaphragm for Speaker".

Patent Abstracts of Japan, Patent No. 11-205893, registered Jul. 30, 1999, Inventors: Kanai Mikiyasu et al., "Diaphragm for Electric Acoustic Converter".

Patent Abstracts of Japan, Publication No. 2002-078076, published Mar. 15, 2002, Inventors: Ono Yuji et al., "Member for Speaker".

Partial Translation, Japanese Utility Model Laid-open Publication No. 3(1991)-77593, published Aug. 5, 1991, Inventors: Musha Mutsuo et al., "Loudspeaker Diaphragm" (2 pp.).

Bartholomé, Prof. Dr. Ernst et al., "Ullmanns Encyklopädie der technischen Chemie", 1976, Verlag Chemie, 4. Neubearbeitete und Erweiterte Auflage, Weinheim/Berstr. XP002279618, p. 305, part 2. "Polyesterfasem", p. 305, part 2.2 "Herstellung von Polyäthyenterephthalat (PÄT)", p. 353, part "Polyälthylen-naphthalat-Fasem" (9 pp.).

* cited by examiner

LOUDSPEAKER DIAPHRAGM AND METHOD FOR MANUFACTURING THE SAME

BACKGROUND OF THE INVENTION

1. Field of the Invention

The present invention relates to a loudspeaker diaphragm and a method for manufacturing such a diaphragm. More particularly, the present invention relates to a loudspeaker diaphragm which is light weight and possesses an excellent balance between rigidity and internal loss, as well as a simple and inexpensive method for manufacturing such a diaphragm.

2. Description of the Related Art

Generally, properties which are required for a loudspeaker diaphragm include a high Young's modulus (a high elastic modulus or rigidity) and an appropriate internal loss (tan δ). A known means for improving Young's modulus, is a diaphragm employing FRP (Fiber Reinforced Plastic), i.e., a composite of a carbon fiber and an epoxy resin, which is a typical example. A known means for improving an internal loss is typically a diaphragm employing a synthetic resin such as polypropylene.

The above-mentioned diaphragms respectively have a problem. Specifically, the FRP diaphragm has a high Young's modulus. However, since an epoxy resin (a matrix resin of FRP) has a very small internal loss, an internal loss of a diaphragm is small as a whole. As a result, such a diaphragm tends to cause a resonance and therefore has frequency characteristics in which a so-called peak dip appears very much. Accordingly, it is quite difficult to prevent production of sound which is inherent in a diaphragm material. Regarding the synthetic resin diaphragm, in many cases, it has satisfactory frequency characteristics due to its large internal loss. However, the synthetic resin diaphragm has insufficient rigidity and heat resistance.

As means that improves a balance between a rigidity (Young's modulus) and an internal loss, a diaphragm employing a polyethylene naphthalate film is proposed in, for example, JP 01-067099 A and JP 06-181598 A.

Furthermore, since a request for reducing the weight of a diaphragm has recently become intensive, various attempts have been made. For example, a light weight diaphragm, which has an unfoamed structure on the surface portion and a foamed structure at the inner portion and which is obtained by using a thermoplastic resin to which a foaming agent is added and by adjusting clamping force on a mold cavity and a mold clearance at the time of performing an injection molding, is proposed in JP 3135482 B. Alternatively, as an attempt that simultaneously satisfies mechanical strength and reduction in weight, a foamed resin product, which has two cell structures respectively having a different foam density, is proposed in JP 11-080408 A. This foamed resin product is obtained by impregnating a resin with carbon dioxide gas having concentration gradient in a supercritical state and by heating the impregnated resin to be foamed.

However, techniques described in the above-mentioned publications respectively have a problem as follows. A technique described in JP 01-067099 A and JP 06-181598 A is applicable only to a loudspeaker having a small diameter (i.e., a so-called micro speaker). More specifically, according to the technique described in these publications, it is possible to obtain a diaphragm having sufficient rigidity and internal loss for being used for a micro speaker. However, since an internal loss of such a diaphragm is extremely insufficient for being used for a loudspeaker having a large diameter, it is impossible for the technique to obtain a practically acceptable diaphragm used for a loudspeaker having a large diameter.

According to a technique described in JP 3135482 B, it is extremely difficult to adjust the time at which a foaming is performed and the time at which the clamping force and mold clearance is varied. As a result, it is difficult to stably obtain a diaphragm having a satisfactory balance between mechanical strength and weight. According to a technique described in JP 11-080408 A, since a resin molded product (e.g., a sheet) is impregnated with gas, it requires an excessive amount of time to be sufficiently impregnated with the gas. For example, in the case where a resin having high crystallinity is used for improving mechanical strength, it may take 100 hours or more for gas impregnation. Therefore, this technique is not at all commercially practicable.

As mentioned above, a loudspeaker diaphragm which is light weight and possesses excellent balance between rigidity and internal loss in a variety of uses (i.e., regardless of the diameter of a resultant loudspeaker), coupled with a simple and inexpensive method for manufacturing such a diaphragm has been in great demand.

SUMMARY OF THE INVENTION

The present invention is intended to solve the above-mentioned problems. Accordingly, the present invention provides a loudspeaker diaphragm having light weight and excellent balance between rigidity and internal loss in any uses, as well as a simple and inexpensive method for manufacturing such a diaphragm.

According to an aspect of the present invention, a loudspeaker diaphragm comprising a base layer having a woven fabric of a polyethylene naphthalate fiber impregnated with a thermosetting resin is provided.

In one embodiment of the invention, the thermosetting resin is an unsaturated polyester resin or a melamine resin.

In another embodiment of the invention, the polyethylene naphthalate fiber is an untwisted fiber.

In still another embodiment of the invention, at least part of the polyethylene naphthalate fiber is coated with a second thermosetting resin.

In still another embodiment of the invention, the thermosetting resin is an unsaturated polyester resin and the second thermosetting resin is an epoxy resin or a melamine resin.

In still another embodiment of the invention, a fiber/resin ratio in the base layer is in the range of 60/40 to 80/20.

In still another embodiment of the invention, the loudspeaker diaphragm further comprises a thermoplastic resin layer.

In still another embodiment of the invention, the thermoplastic resin layer contains at least one selected from the group consisting of nylon, polyester, polyolefin, polystyrene, polyvinyl chloride, polyurethane polysulfone, polyether ketone, polyether ether ketone, polyacetal, polyalylate, polyamide, polyamideimide, polycarbonate, modified polyphenylene ether, polyphenylene sulfide, polyacrylate, polymethyl methacrylate, polyetherimide, polyether sulfone, polytetrafluoroethylene, a liquid crystal polymer and a thermoplastic elastomer.

In still another embodiment of the invention, the loudspeaker diaphragm further comprises a thermoplastic elastomer layer.

In still another embodiment of the invention, the thermoplastic elastomer layer contains at least one selected from the group consisting of a polyester elastomer, a polyurethane elastomer and a polyolefin elastomer.

In still another embodiment of the invention, the thermoplastic resin layer has a finely foamed structure.

In still another embodiment of the invention, an average diameter of a cell in the finely foamed structure is 10 to 60 μm.

In still another embodiment of the invention, the base layer comprises a woven fabric of cotton or an unwoven fabric of a liquid crystal polymer.

According to another aspect of the invention, a loudspeaker comprising a loudspeaker diaphragm having a base layer that has a woven fabric of a polyethylene naphthalate fiber impregnated with a thermosetting resin is provided.

According to still another aspect of the invention, a method for manufacturing a loudspeaker diaphragm is provided. The method comprises the steps of: impregnating a woven fabric of a polyethylene naphthalate fiber with a thermosetting resin and curing the thermosetting resin, so as to form a base layer; adding inactive gas in a supercritical state to a molten thermoplastic resin and extruding the mixture of the thermoplastic resin and the inactive gas at prescribed temperature and pressure, so as to form a thermoplastic resin layer; and laminating the base layer and the thermoplastic resin layer.

In one embodiment of the invention, the inactive gas is selected from the group consisting of nitrogen, carbon dioxide, argon, neon, helium, oxygen and mixed gas thereof.

According to still another aspect of the invention, a loudspeaker diaphragm comprising a base layer as the outermost layer, a thermoplastic resin layer and a thermoplastic elastomer layer, wherein the base layer has a woven fabric of a polyethylene naphthalate fiber impregnated with a thermosetting resin is provided.

In one embodiment of the invention, the thermoplastic resin layer is an intermediate layer composed of a film and the thermoplastic elastomer layer is the innermost layer composed of a woven fabric or an unwoven fabric.

In another embodiment of the invention, a thermoplastic elastomer constituting the thermoplastic elastomer layer has a melting point higher than that of a thermoplastic resin constituting the thermoplastic resin layer.

Instill another embodiment of the invention, the polyethylene naphthalate fiber is a mono-filament.

DETAILED DESCRIPTION OF THE INVENTION

Hereinafter, preferred embodiments of the present invention will be described with reference to accompanying drawings. However, the present invention is not limited to these embodiments.

Figure 1:
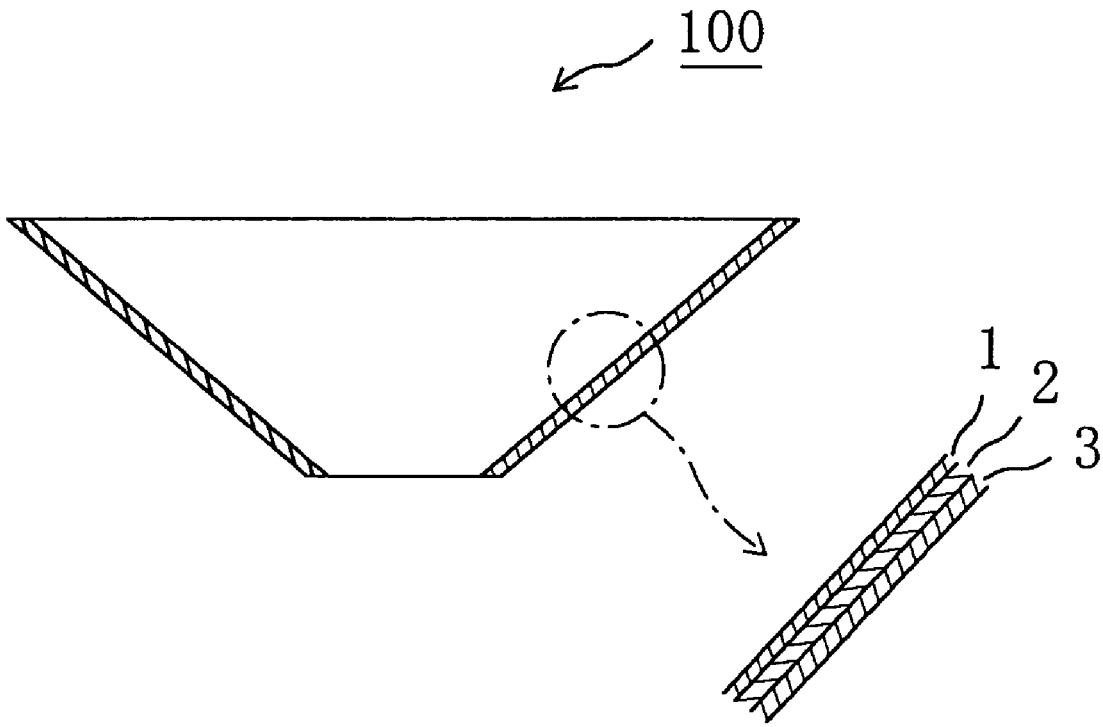
FIG. 1 is a schematic cross sectional view of a loudspeaker diaphragm according to a preferred embodiment of the present invention.

FIG. 1 is a schematic cross sectional view of a loudspeaker diaphragm according to a preferred embodiment of the present invention. The diaphragm 100 includes a base layer 1. Furthermore, the diaphragm 100 may optionally include a thermoplastic resin layer 2 and a thermoplastic elastomer layer 3. In a diaphragm according to the present invention, it is preferred that the base layer 1 is the outermost layer (i.e., a layer at the side where sound wave is radiated). This is because a loudspeaker diaphragm having an excellent appearance of glossy textile pattern can be obtained. Other than this, the order of the respective layers to be laminated is not specifically limited. Accordingly, the base layer 1, the thermoplastic resin layer 2 and the thermoplastic elastomer layer 3 may be laminated in this order as shown in FIG. 1 or the base layer 1, the thermoplastic elastomer layer 3 and the thermoplastic resin layer 2 may be laminated in this order.

The base layer 1 includes a woven fabric of a polyethylene naphthalate (PEN) fiber impregnated with a thermosetting resin. As the thermosetting resin, any suitable thermosetting resin can be employed. Preferred examples of the thermosetting resin include an unsaturated polyester resin and a melamine resin. Since an unsaturated polyester resin can be rapidly cured at low temperature, it would be simple and easy to manufactured a loudspeaker diaphragm by using an unsaturated polyester resin. Furthermore, a loudspeaker diaphragm having an excellent internal loss can be obtained. A melamine resin largely contributes to improvement of mechanical strength.

As a texture of the PEN woven fabric in the base layer 1, any suitable texture (e.g., plain weave, twill weave, sateen weave and the combination thereof) can be employed. Plain weave is preferred. Since mechanical strength in warp and weft directions is large, it is easy to perform a deep drawing molding. Plain weave is especially preferred for being used for a corn-shaped loudspeaker diaphragm having a large diameter. In the case of plain weave, METSUKE (corresponding to weave density or fabric density) is preferably 150 to 190 g/m$^2$ and more preferably 160 to 180 g/m$^2$. Here, METSUKE is one of indices of density of woven or unwoven fabric and is meant to be weight of a fabric per unit area. Since weave density in such a range is remarkably larger than that of a conventional woven fabric, an effect improving mechanical strength would be significantly increased. Furthermore, plain weave having weave density in such a range indicates an excellent moldability.

Preferably, a PEN fiber constituting the above-mentioned woven fabric is an untwisted fiber. By using an untwisted fiber, it is possible to extremely reduce thickness per unit weave density. As a result, a diaphragm having light weight and excellent mechanical strength can be obtained. For example, a usual thermoplastic resin fiber is twisted and a woven fabric thereof has thickness of approximately 1 mm if weave density is approximately 170 g/m$^2$. In contrast, a plain weave fabric of an untwisted PEN fiber has thickness of approximately 0.18 mm if weave density is the same as that of a usual thermoplastic resin fiber. In other words, a woven fabric of the untwisted PEN fiber has thickness of less than one fifth compared to a usual thermoplastic resin fiber. If such a woven fabric is used, an amount of an impregnating resin can be remarkably reduced (in other words, a ratio of a fiber to a resin in the base layer can be remarkably increased) As a result, an internal loss can be significantly improved. Details of a ratio of a fiber to a resin will be described later. Although fineness of the PEN fiber can vary appropriately depending on the objective diaphragm, it is preferably 800 to 1,200 denier (88.8 to 133.3 Tex). If the fineness of the fiber is less than 800 denier, weave density would be reduced so that mechanical strength of a diaphragm would be insufficient in many cases. If the fineness of the fiber is more than 1200 denier, weight would be increased so that sound pressure would be deteriorated in many cases. Preferably, the PEN fiber is a mono-filament. By using a mono-filament, since irregular reflection would occur at the inner surface of a fabric, a loudspeaker diaphragm having an excellent appearance (specifically, a glossy textile pattern) can be obtained.

Preferably, at least part of the PEN fiber is coated with a second thermosetting resin. As the second thermosetting resin, a thermosetting resin other than the above-mentioned impregnating resin can be appropriately selected. In the case where the PEN woven fabric is impregnated with an unsaturated polyester resin, preferred examples of the second thermosetting resin include an epoxy resin and a melamine resin. Since wettability of the surface of the PEN fiber with the unsaturated polyester resin would be improved by coating the PEN fiber with an epoxy resin or a melamine resin, a reinforced degree of the unsaturated polyester resin with the PEN fiber would be significantly increased. As a result, a loudspeaker diaphragm having an excellent Young's modulus can be obtained. On the other hand, since the coated PEN fiber and the unsaturated polyester resin appropriately slip each other when a diaphragm is vibrated, an appropriate internal loss is maintained. Such coating is performed by a usual impregnating operation. A coating amount is adjusted by varying an amount of an impregnating resin. A preferred example of the coating amount of the resin is 3 to 7 parts by weight and more preferably in the vicinity of 5 parts by weight based on 100 parts by weight of the base layer.

A ratio of a fiber to a resin (a fiber/resin ratio) in the base layer 1 is preferably in the range of 60/40 to 80/20 and more preferably in the range of 70/30 to 80/20. By using a base layer having a high fiber/resin ratio, a loudspeaker diaphragm having an excellent internal loss can be obtained without deteriorating the Young's modulus. Here, the term "fiber/resin ratio means a ratio by weight of the weight of a woven fabric before impregnation to the weight of an impregnating resin. As described above, such extremely high fiber/resin ratios can be realized by using an untwisted fiber as a fiber constituting a base layer (i.e., a PEN fiber in the present invention).

A loudspeaker diaphragm according to the present invention may optionally include a thermoplastic resin layer 2. By providing a thermoplastic resin layer 2, it is possible to prevent production of inherent sound which tends to be produced in the case where a base layer is formed alone. As a result, a loudspeaker diaphragm having frequency characteristics containing no peak dip can be obtained. The thermoplastic resin layer 2 may be a woven fabric, an unwoven fabric or a film. For example, in the case where a loudspeaker diaphragm according to the present invention has a two-layer structure including a base layer 1 and a thermoplastic resin layer 2 or where a thermoplastic resin layer 2 is an intermediate layer as shown in FIG. 1, the thermoplastic resin layer 2 is preferably a film. Since the resin constituting the thermoplastic resin layer 2 would easily flow into a space of the base layer 1 at the time when molding is performed, wettability of the surface of the PEN fiber constituting the base layer 1 can be improved. As a result, a loudspeaker diaphragm having an excellent Young's modulus (rigidity) can be obtained. In contrast, in the case where a thermoplastic resin layer 2 is the innermost layer of a three-layer structure, the thermoplastic resin layer 2 is preferably a woven fabric or an unwoven fabric. This is because a resin of an intermediate layer would easily flow into a space of the thermoplastic layer 2.

Examples of a resin constituting the thermoplastic resin layer include nylon (such as nylon-6 or nylon-66), polyester (such as polyethylene terephthalate or polybutylene terephthalate), polyolefin (such as polyethylene, ultrahigh molecular weight polyethylene, polypropylene or, poly(4-methyl-1-pentene)), polystyrene, polyvinyl chloride, polyurethane, polysulfone, polyether ketone, polyether ether ketone, polyacetal, polyalylate, polyamide, polyamideimide, polycarbonate, modified polyphenylene ether, polyphenylene sulfide, polyacrylate, polymethyl methacrylate, polyether imide, polyether sulfone, polytetrafluoroethylene, a liquid crystal polymer and a thermoplastic elastomer. These can be used alone or in blend. A copolymer obtained from two or more monomers of these resins can also be used. Polyester, nylon and polyolefin are preferred. Nylon and polyolefin are especially preferred. This is because these resins have an excellent periodic damping property.

Preferably, the thermoplastic resin layer 2 has a finely foamed structure. An average diameter of a cell in the finely foamed structure is preferably 10 to 60 μm, more preferably 20 to 50 m, and most preferably 30 to 40 m. If the thermoplastic resin layer 2 has a finely foamed structure, it is possible to provide a loudspeaker diaphragm having excellent mechanical strength in spite of having light weight. Especially, such a fine cell is advantageous for improving durability and reliability. In addition, since such a fine cell has an effect of increasing an internal loss (tan δ) which is a very important factor for an audio component, it is possible to reduce unnecessary sound which is radiated when a diaphragm is vibrated. Cell density of the finely foamed structure is preferably $10^9$ to $10^{15}$ cell/cm$^3$ and more preferably $10^{10}$ to $10^{14}$ cell/cm$^3$. An expansion ratio corresponding to such cell density is approximately 1.2 to 3.0. If the thermoplastic resin layer has such cell density, a balance between mechanical strength and weight can be further improved.

A process for producing the above-mentioned finely foamed structure (in the present embodiment, a process for producing a foamed sheet) is as follows. Initially, a resin sheet is placed in a high pressure container at room temperature. Then, high pressure inactive gas is sufficiently dissolved to the extent that a saturated state is produced in the container. Typical examples of the inactive gas include nitrogen, carbon dioxide, argon, neon, helium, oxygen and mixed gas thereof. Nitrogen and carbon dioxide are preferred because they are inexpensive and easy to handle. Then, gas pressure in the high pressure container is suddenly reduced while the temperature therein is kept at room temperature, so as to produce a supersaturated state of the gas in the resin sheet. At that time, the sheet becomes thermodynamically extremely unstable so that a core of a cell is produced. The sheet is heated to a temperature higher than the softening temperature of the sheet so that the cell expands/grows. Thereafter, the sheet is cooled to obtain a foamed sheet. Alternatively, a resin sheet is placed in a high pressure container at high temperature. Then, high pressure inactive gas is sufficiently dissolved under a high temperature and high pressure condition to the extent that a saturated state is produced in the container. Then, the gas is suddenly removed so that supersaturation of the gas, production of a core of a cell and growth of the cell simultaneously progress. Thereafter, the sheet is cooled to obtain a foamed sheet.

Figure 2:
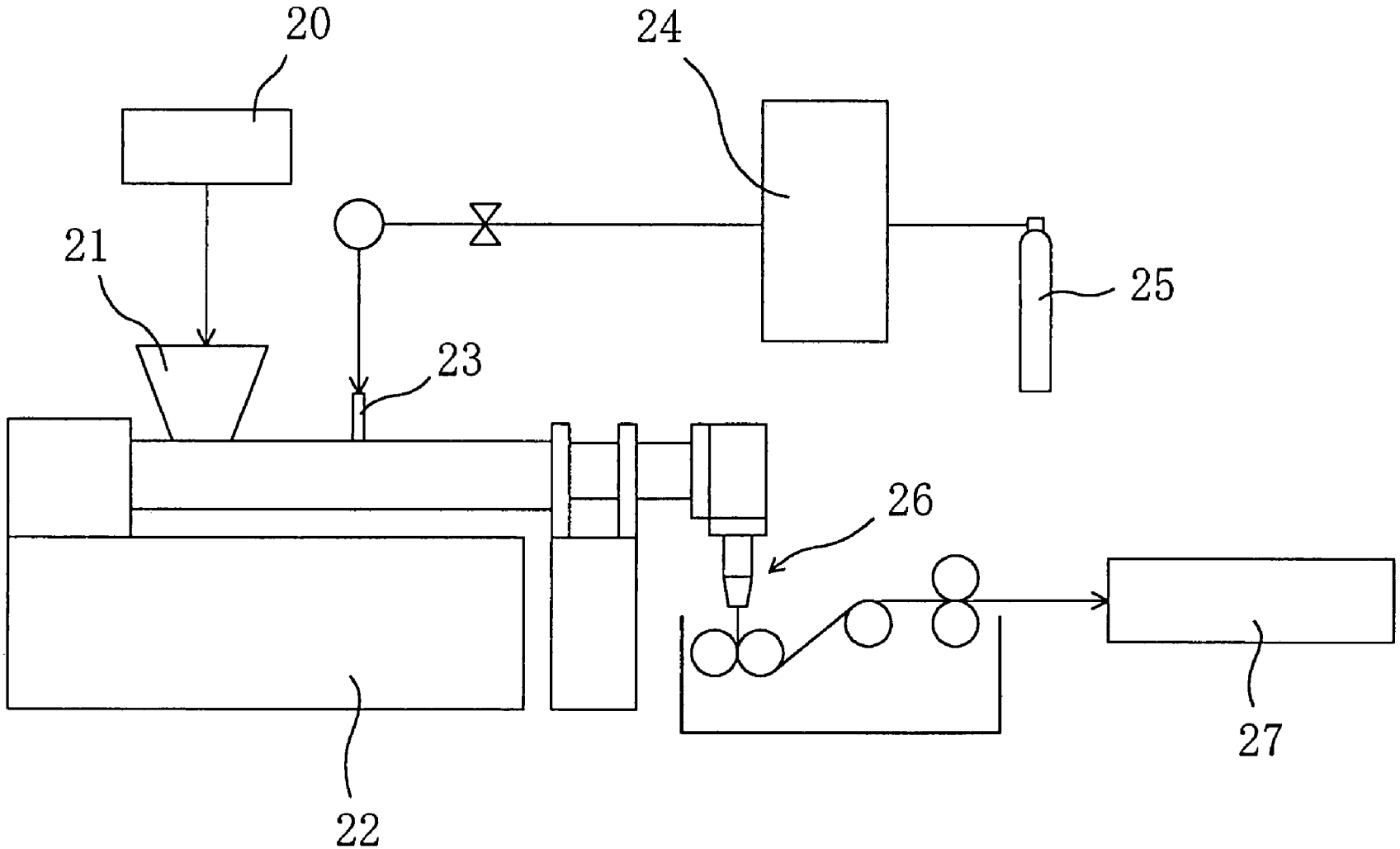
FIG. 2 is a schematic view illustrating a method for forming a thermoplastic resin layer of a loudspeaker diaphragm according to a preferred embodiment of the present invention.

Alternatively, as shown in FIG. 2, the finely foamed structure can be formed simultaneously with a sheet molding by use of an extruder. More specifically, a thermoplastic resin 20 as a raw material is charged into an extruder 22 through a hopper 21 and is molten in the extruder 22 typically at a temperature of 180 to 220° C. Then, inactive gas (typically, nitrogen, carbon dioxide, argon, neon, helium, oxygen or mixed gas thereof) in a supercritical state is added thereto at a prescribed amount (typically, 10 to 30 parts by weight based on 100 parts by weight of the resin) through the middle portion 23 of the extruder. Here, reference numeral 24 denotes inactive gas in a liquid state and reference numeral 25 denotes a SCF (Supercritical Fluid) system that produces a supercritical state. Then, the molten thermoplastic resin and the inactive gas are kneaded while the pressure of the inactive gas (a foaming gas) in the extruder kept at a critical pressure or higher. By keeping the inactive gas in a supercritical state, the inactive gas is incorporated and dispersed into the molten thermoplastic resin in an extremely short time so that an excellent compatible state can be realized. This is because viscosity in a supercritical state is lower than that in a liquid state and a diffusion property in a supercritical state is much higher than that in a liquid state. The mixture of the molten thermoplastic resin and the inactive gas is fed to a sheet molding die 26 being controlled at prescribed temperature (typically, 130 to 150° C.) so that a foamed sheet 27 is obtained. Such a foamed sheet (a thermoplastic resin layer 2) and a PEN woven fabric (a base layer 1) are laminated to obtain a diaphragm according to the present invention. In the present specification, the term "supercritical state" means a state wherein the gas is at a critical temperature or greater and is at a critical pressure or greater. Regarding nitrogen gas, the critical temperature is −127° C. and the critical pressure is 3.5 MPa. Regarding carbon dioxide gas, the critical temperature is 31° C. and the critical pressure is 7.4 MPa.

Also in the case where a thermoplastic resin layer 2 has a finely foamed structure, the aforementioned thermoplastic resin can be preferably used. In this case, an especially preferred resin is polyolefin. This is because a satisfactorily finely foamed structure can be obtained.

A loudspeaker diaphragm according to the present invention may optionally include a thermoplastic elastomer layer 3. The thermoplastic elastomer layer 3 may be a woven fabric, an unwoven fabric or a film. For example, as shown in FIG. 1, in the case where a thermoplastic elastomer layer 3 is the innermost layer, the thermoplastic elastomer layer 3 is preferably a woven fabric or an unwoven fabric. This is because a resin constituting a thermoplastic resin layer 2 would easily flow into a space of the thermoplastic elastomer layer 3 at the time when molding is performed. As a result, since wettability of the surface of the PEN fiber can be improved, a loudspeaker diaphragm having an excellent Young's modulus (rigidity) can be obtained. In contrast, in the case where a thermoplastic elastomer layer 3 is an intermediate layer, the thermoplastic elastomer layer 3 is preferably a film. The thermoplastic elastomer would easily flow into a base layer 1 and/or a thermoplastic resin layer 2.

As a thermoplastic elastomer constituting the thermoplastic elastomer layer 3, a polyester elastomer, a polyurethane elastomer and a polyolefin elastomer are exemplified. These can be used alone or in combination. In the case where the thermoplastic elastomer layer 3 is the innermost layer, these thermoplastic elastomers preferably have a melting point higher than that of a resin constituting the thermoplastic resin layer 2. If the elastomer and the resin have such relationship, the thermoplastic resin would especially easily flow into a space of the thermoplastic elastomer layer 3. In contrast, in the case where the thermoplastic elastomer layer 3 is an intermediate layer, these thermoplastic elastomers preferably have a melting point lower than that of a resin constituting the thermoplastic resin layer 2. If the elastomer and the resin have such relationship, the thermoplastic elastomer would especially easily flow into a space of the base layer 1 and/or the thermoplastic resin layer 2. Especially preferred thermoplastic elastomer is a polyester elastomer. This is because a loud speaker diaphragm having an excellent internal loss can be obtained.

The entire thickness of a loudspeaker diaphragm according to the present invention is preferably 0.1 to 1 mm and more preferably 0.2 to 0.6 mm. Such thickness is practically advantageous when a diaphragm is incorporated into a loudspeaker unit. In the case where a loudspeaker diaphragm has a laminated structure, the thickness of a base layer 1 is preferably 0.05 to 0.4 mm and more preferably 0.1 to 0.25 mm. If the base layer has such thickness, a loudspeaker diaphragm having an excellent balance between a rigidity and an internal loss can be obtained. In the case where a thermoplastic resin layer 2 is formed, the thickness of the thermoplastic resin layer 2 is preferably 0.05 to 0.6 mm and more preferably 0.1 to 0.35 mm. In the case where the thermoplastic resin layer has a finely foamed structure, the thickness of the thermoplastic resin layer 2 is preferably 0.05 to 0.6 mm and more preferably 0.2 to 0.4 mm. If the thermoplastic resin layer has such thickness, loudspeakers having various diameters and having an excellent balance between a rigidity and an internal loss can be obtained. Furthermore, in the case where a thermoplastic elastomer layer 3 is formed, the thickness of the thermoplastic elastomer layer 3 is preferably 0.01 to 0.1 mm and more preferably 0.04 to 0.08 mm.

A loudspeaker diaphragm according to the present invention may have any suitable layer in addition to or in place of the thermoplastic resin layer 2 and the thermoplastic elastomer layer 3. For example, in the case where the thermoplastic resin layer 2 has a finely foamed structure, a diaphragm may have an adhesive layer or an additional thermoplastic elastomer layer between the base layer 1 and the thermoplastic resin layer 2. In this case, adhesion between the base layer 1 and the thermoplastic resin layer 2 would be enhanced and an internal loss would be further improved. Alternatively, a cotton woven fabric layer or a liquid crystal polymer unwoven fabric layer may be formed. Such a layer is formed to appropriately adjust a balance between a rigidity (mechanical strength) and an internal loss. Typical examples of a liquid crystal polymer include aromatic polyester and aromatic polyamide. Aromatic polyester is commercially available from Nippon Petrochemicals Co., Ltd. under a trade name of XYDER and from Kuraray Co., Ltd. under a trade name of Vectran. Aromatic polyamide is commercially available from DuPont-Toray Co., Ltd. under a trade name of KEVLER and from Teijin Limited under a trade name of Technora. The thickness of such a layer, weave density or a texture of a woven fabric, a method of forming an unwoven fabric or the like can be appropriately selected depending upon the objective diaphragm.

Hereinafter, functions of the present invention will be described.

According to the present invention, a loudspeaker diaphragm having a base layer including a woven fabric of a polyethylene naphthalate (PEN) fiber impregnated with a thermosetting resin is provided. Such a loudspeaker diaphragm has an excellent balance between a Young's modulus and an internal loss. The details are as follows. If a woven fabric is used for a base layer, respective fibers constituting the base layer would easily slip when a diaphragm is vibrated. As a result, vibration energy is converted into heat energy so that an internal loss would become large. Furthermore, since a PEN woven fabric used in the present invention has an extremely large weave density, there exists a small amount of a thermosetting resin as a binder resin between fibers constituting the woven fabric in the resultant diaphragm. As a result, a laminated structure having a woven fabric layer and a resin layer is substantially formed in the base layer and such a structure contributes to further improvement of an internal loss. In addition, due to the extremely large weave density of the PEN woven fabric, Young's modulus can be satisfactorily maintained. Accordingly, a loudspeaker diaphragm simultaneously possessing an excellent Young's modulus and internal loss, which could not be obtained by prior art, can now be realized.

In a preferred embodiment of the present invention, the above-mentioned PEN fiber is an untwisted fiber. By using an untwisted fiber, it is possible to extremely reduce thickness per weave density. As a result, a diaphragm having light weight and excellent mechanical strength can be obtained. Furthermore, if a woven fabric employing such a fiber is used, since it is possible to remarkably reduce an amount of an impregnating resin (in other words, to remarkably increase the fiber/resin ratio in the base layer), an internal loss can be remarkably improved. According to the present invention, since the fiber/resin ratio in the range of 60/40 to 80/20 can be realized, a loudspeaker diaphragm having a very small amount of a resin can be obtained. As a result, due to slip of the respective PEN fibers, an extraordinarily improved internal loss can be realized compared to a film diaphragm. Actually, a loudspeaker diaphragm according to the present invention has an internal loss of more than ten times as much as that of a PEN film diaphragm described in JP 06-181598 A (specifically, an internal loss of Example 1 described later is 0.45 while an internal loss of the PEN film diaphragm is 0.038).

In a preferred embodiment, a loudspeaker diaphragm according to the present invention has a thermoplastic resin layer and/or a thermoplastic elastomer layer. Therefore, it is possible to prevent production of inherent sound which tends to be produced in the case where a base layer is formed alone. As a result, a loudspeaker diaphragm having frequency characteristics containing no peak dip can be obtained.

In a preferred embodiment, the thermoplastic resin layer has a finely foamed structure. If the thermoplastic resin layer has a finely foamed structure, it is possible to provide a loudspeaker diaphragm having excellent mechanical strength in spite of having light weight. Especially, such a finely foamed structure is advantageous for improving durability and reliability. In addition, since such a finely foamed structure has an effect increasing an, internal loss (tan δ) which is very important factor for an audio component, it is possible to reduce unnecessary sound which is radiated when a diaphragm is vibrated.

In addition, according to the present invention, a simple and inexpensive method for manufacturing the above-mentioned diaphragm is provided. Specifically, by using inactive gas in a supercritical state, extrusion molding and foaming of a foamed sheet (a thermoplastic resin layer) can be simultaneously performed using an extruder for a sheet forming. Since such a manufacturing method does not require large scale and high pressure facilities, cost and productivity can be remarkably improved.

EXAMPLES

Hereinafter, the present invention will be specifically described by showing examples. However, the present invention is not limited to these examples. Without contrary indications, a part(s) and a percent(s) in the examples are based on weight.

Example 1

An unsaturated polyester solution having the following composition was prepared:

Unsaturated polyester resin (N350L, produced by Nippon, Shokubai Co., Ltd.) 100 (parts)

Low shrinking agent (MODIPER S501, produced by NOF Corporation) 5 (parts)

Curing agent (PEROCTA O, produced by NOF Corporation) 1.3 (parts)

A cotton woven fabric (yarn number count of cotton: #20, 40 warps and 40 wefts, and weave density: 110 g/m$^2$) was cut into 15 cm length and 15 cm width. A plain woven fabric of a PEN fiber (produced by Teijin Limited, fineness: 1,100 decitex, 17 warps and 17 wefts per inch, and weave density: 166 g/m$^2$), which was cut into 15 cm length and 15 cm width, was placed on the cut cotton woven fabric to obtain a two-layer laminate.

An opening having approximately 13 cm diameter was formed at the center portion of a stainless steel plate having approximately 16 cm length and 16 cm width to obtain a jig. Two jigs were prepared. The above-mentioned laminate was sandwiched between the two jigs. Approximately 5 g of the above-mentioned unsaturated polyester solution was dropped from the upper side. (i.e., from the side of the PEN woven fabric) onto the portion in the vicinity of the center portion of the laminate. Then, the laminate was subjected to molding using a matched die (mold) having a prescribed shape at 130° C. for 30 seconds, so as to obtain a loudspeaker diaphragm having 12 cm diameter and 0.25 mm thickness.

Figure 3:
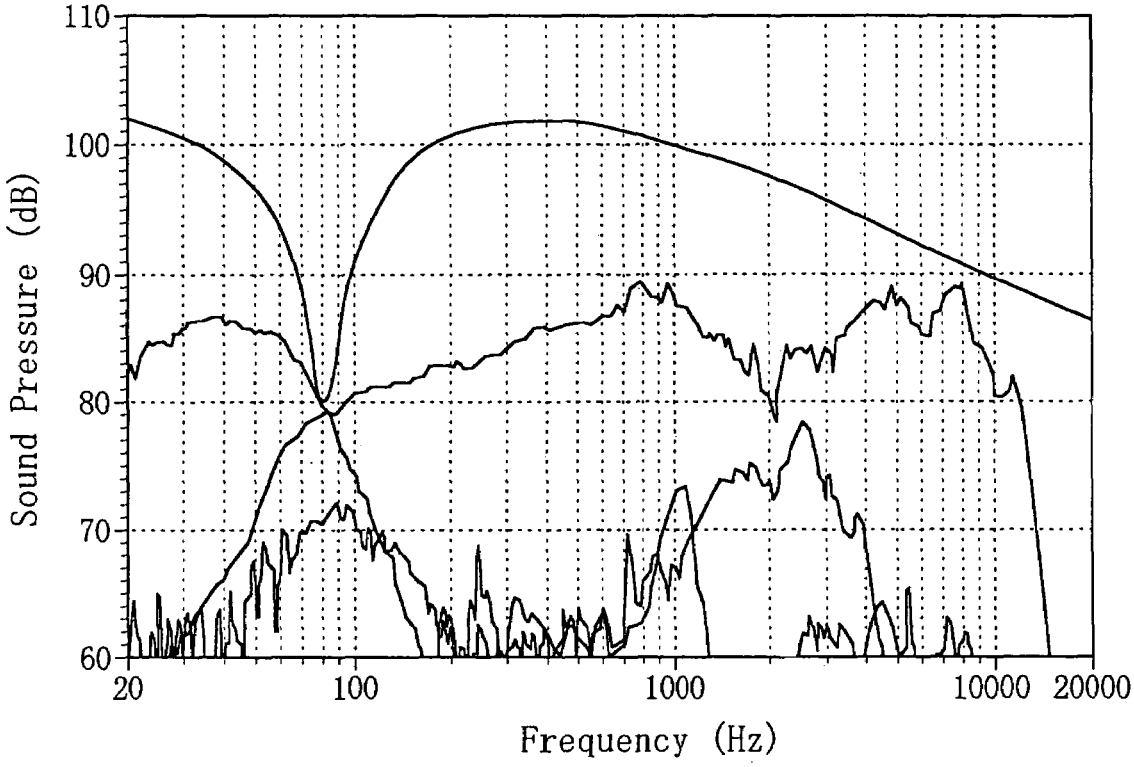
FIG. 3 is a diagram illustrating frequency characteristics of a loudspeaker employing a diaphragm of an example of the present invention.

Density, weight, Young's modulus and internal loss (tan δ) were measured in accordance with a conventional method with regard to the thus-obtained diaphragm. The results of the measurements together with those of Examples 2 and 3 and Comparative Example 1 (described later) are shown in Table 1 as indicated below. Furthermore, frequency characteristics of a loudspeaker employing the thus-obtained diaphragm were measured. The results are shown in FIG. 3. In addition, the fiber/resin ratio of the diaphragm in Example 1 was 78/22.

TABLE 1

| | Density (g/cm$^3$) | Weight (g) | Young's modulus (dyne/cm$^2$) | Specific elasticity (dyne · cm/g) | Internal loss (tan δ) |
|---|---|---|---|---|---|
| Example 1 | 1.01 | 2.30 | $3.44 \times 10^{10}$ | $3.41 \times 10^{10}$ | 0.45 |
| Example 2 | 1.05 | 2.30 | $4.50 \times 10^{10}$ | $4.29 \times 10^{10}$ | 0.47 |
| Example 3 | 1.01 | 2.30 | $5.20 \times 10^{10}$ | $5.15 \times 10^{10}$ | 0.45 |
| Comparative Example 1 | 1.20 | 2.40 | $3.20 \times 10^{10}$ | $2.67 \times 10^{10}$ | 0.22 |

In addition, with regard to the thus-obtained diaphragm, a contact angle was measured using a contact angle measuring apparatus (CA-Q1, manufactured by Kyowa Interface Science Co., Ltd.). The result together with that of Example 3 (described later) is shown in Table 2.

TABLE 2

| | Contact angle (degree) |
|---|---|
| Example 1 | 25 |
| Example 3 | 85 |

Example 2

Figure 4:
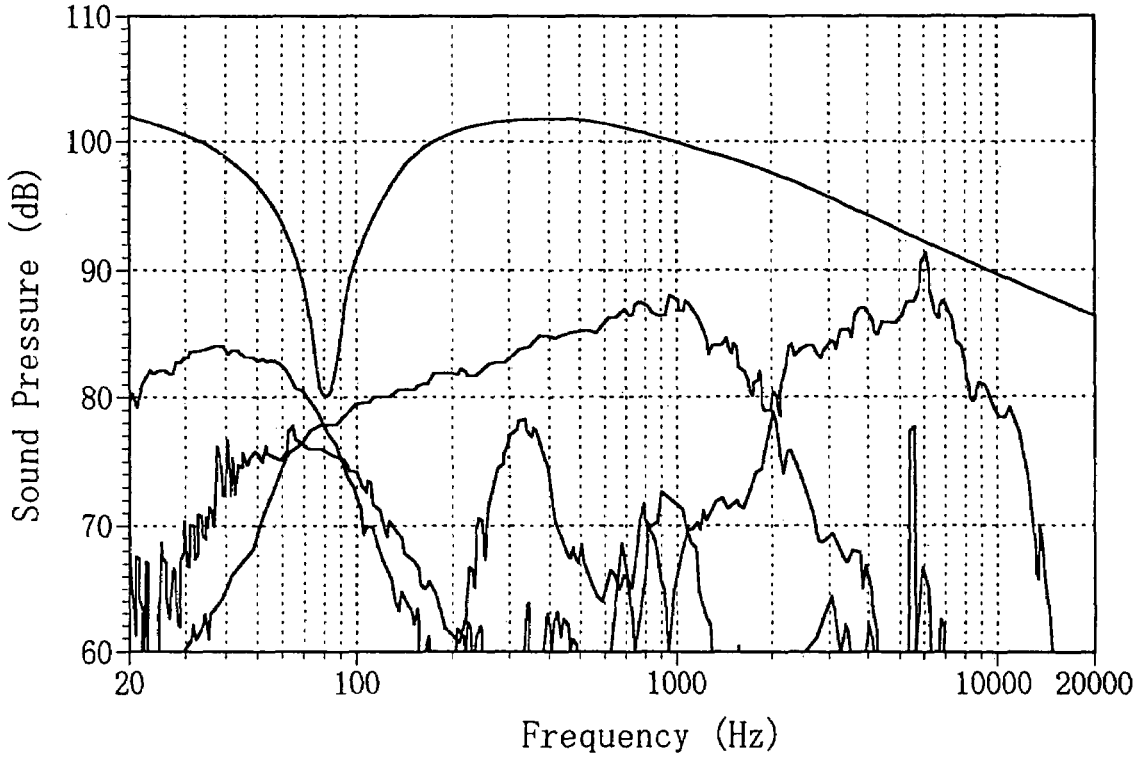
FIG. 4 is a diagram illustrating frequency characteristics of a loudspeaker employing a diaphragm of another example of the present invention.

A loudspeaker diaphragm was manufactured in the same manner as Example 1 except that a liquid crystal polymer unwoven fabric (produced by Kuraray Co., Ltd., trade name: Vectran, fineness of fiber: 1,600 denier, and METSUKE (fabric density): 60 g/m$^2$) was used in place of the cotton woven fabric. The thus-obtained diaphragm was subjected to the same measurement as Example 1. The results are shown in the above-mentioned Table 1. Furthermore, frequency characteristics of a loudspeaker employing the thus-obtained diaphragm were measured. The results are shown in FIG. 4.

Example 3

Figure 5:
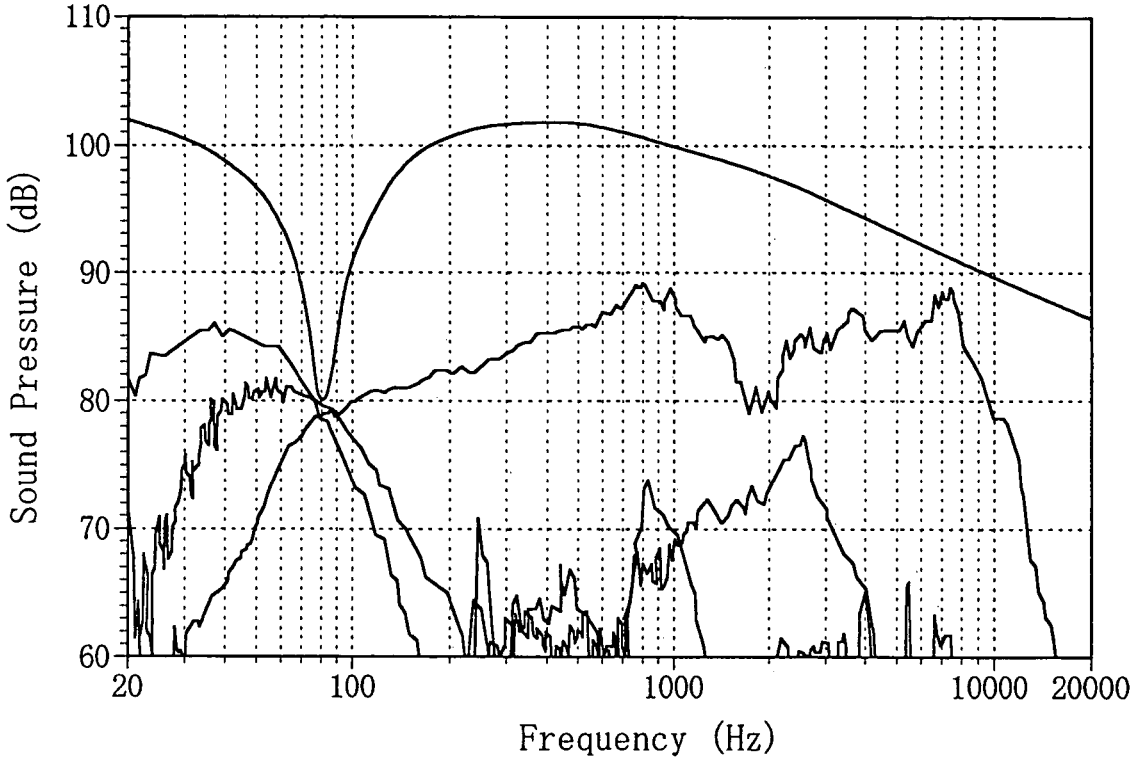
FIG. 5 is a diagram illustrating frequency characteristics of a loudspeaker employing a diaphragm of still another example of the present invention.

A loudspeaker diaphragm was manufactured in the same manner as Example 1 except that the plain weave fabric of the PEN fiber was impregnated with 5 parts of a melamine resin based on 100 parts of the fabric and then laminated on the cotton woven fabric. The thus-obtained diaphragm was subjected to the same measurement as Example 1. The results are shown in the above-mentioned Table 1. Furthermore, frequency characteristics of a loudspeaker employing the thus-obtained diaphragm were measured. The results are shown in FIG. 5. In addition, with regard to the thus-obtained diaphragm, a contact angle was measured in the same manner as Example 1. The result is shown in the above-mentioned Table 2.

Comparative Example 1

Figure 6:
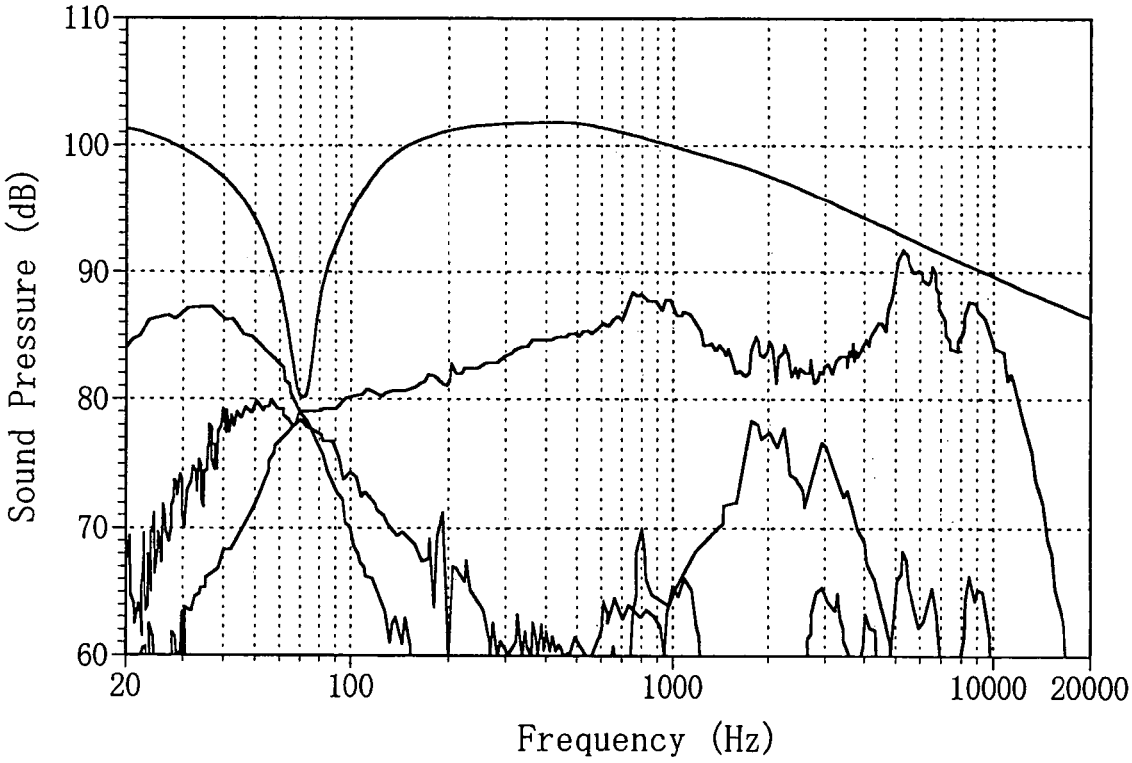
FIG. 6 is a diagram illustrating frequency characteristics of a loudspeaker employing a diaphragm of Comparative Example 1.
Figure 7A:
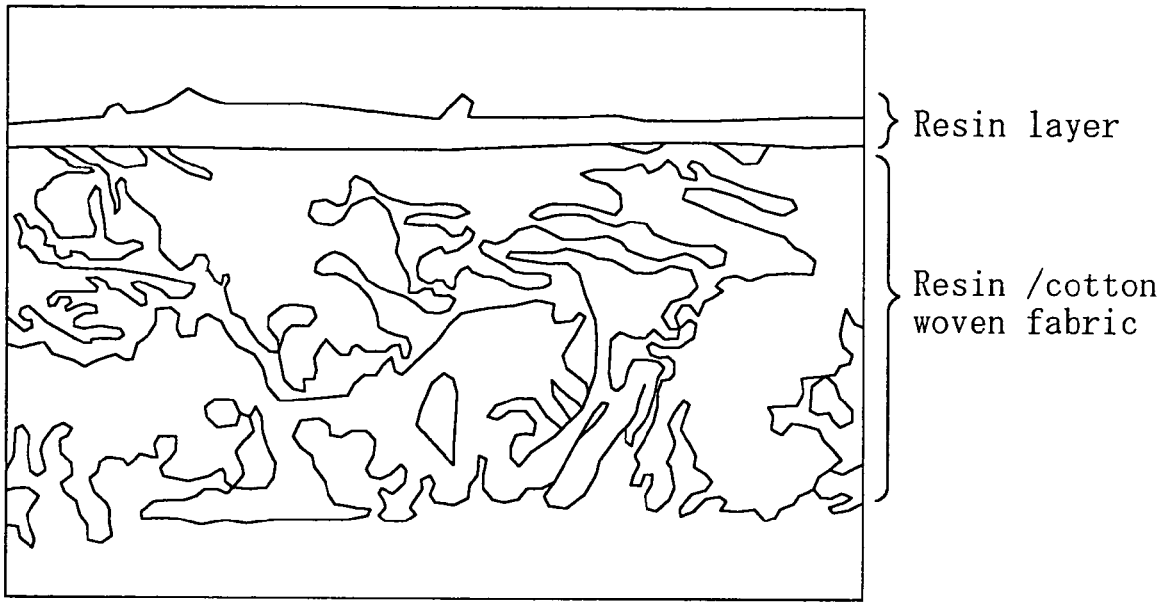
FIGS. 7A and 7B are schematic cross sectional views for illustrating the difference between an internal structure of a diaphragm of an example of the present invention and that of a diaphragm of Comparative Example 1.

A loudspeaker diaphragm was manufactured in the same manner as Example 1 except that a laminate having two layers respectively composed of the cotton fabric in Example 1 was used. The fiber/resin ratio of the thus-obtained diaphragm was 46/54. The thus-obtained diaphragm was subjected to the same measurement as Example 1. The results are shown in the above-mentioned Table 1. Furthermore, frequency characteristics of a loudspeaker employing the thus-obtained diaphragm were measured. The results are shown in FIG. 6. In addition, a schematic cross sectional view of the diaphragm from a picture by an electron microscope is shown in FIG. 7A. Also, a schematic cross sectional view of the diaphragm in Example 3 is shown in FIG. 7B.

As is apparent from Table 1, loudspeaker diaphragms according to examples of the present invention respectively have a superior Young's modulus and internal loss. Especially, the diaphragm in Example 3 in which the PEN fiber is coated with a second thermosetting resin (a melamine resin) has a Young's modulus and internal loss both of approximately two times as much as those of the diaphragm in Comparative Example 3. diaphragm. Also, as is apparent from Table 2, wettability of the diaphragm in Example 3 is remarkably improved compared to that of the diaphragm in Example 1. However, attention should be given that properties of the diaphragm in Example 1 are much superior to those of a prior art diaphragm.

Figure 7B:
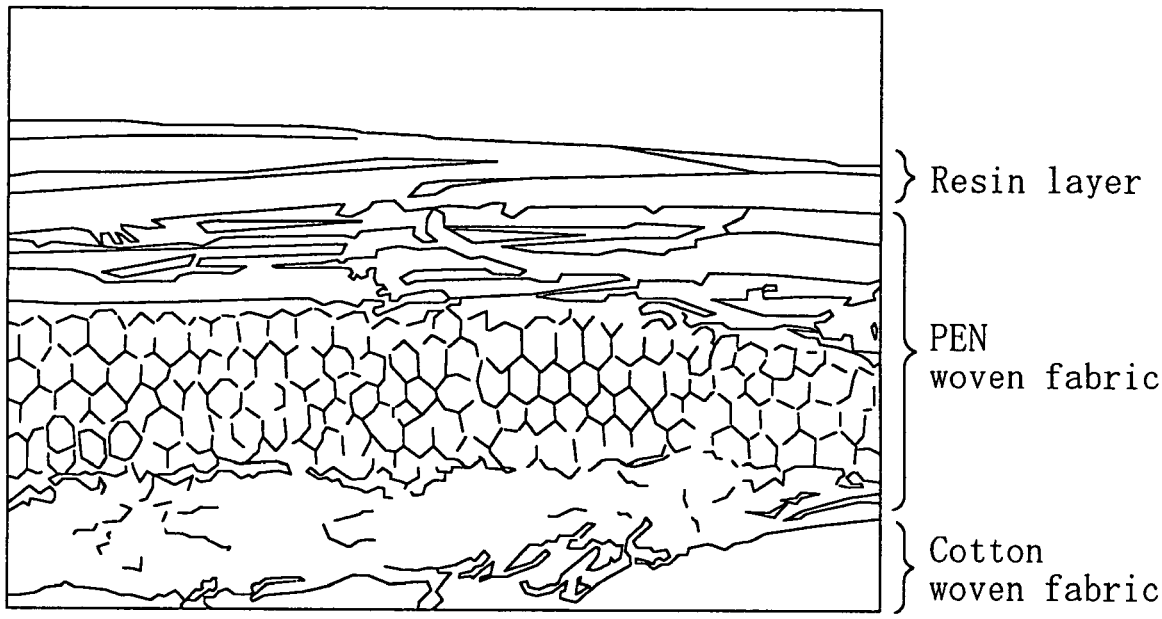

As is apparent from FIG. 7B, a base layer of a diaphragm according to the present invention substantially forms a three-layer structure including a resin layer, a PEN woven fabric layer, and a cotton fabric and resin layer. In contrast, according to the diaphragm in Comparative Example 1, shown in FIG. 7A, a binder resin is incorporated into a space between the fibers constituting the woven fabric. It is conceivable that a loudspeaker diaphragm according to the present invention has a superior internal loss due to a substantially laminated structure of the base layer and that the diaphragm has a superior Young's modulus due to extremely large weave density of the PEN fiber and existence of an appropriate amount of the binder resin in the vicinity of the PEN fiber.

Example 4

A plain woven fabric of an untwisted PEN fiber (produced by Teijin Limited, fineness: 1,100×1,100 decitex, 17 warps and 17 wefts per inch, and weave density: 166 g/m$^2$) was impregnated with a melamine resin and the melamine resin was cured, so as to obtain a base layer. An impregnating amount of the melamine resin was 30 parts based on 100 parts of the PEN fiber fabric. Furthermore, a polyester-elastomer film (produced by Toyobo Co., Ltd., PELPRENE, and thickness of 80 μm) was used as a thermoplastic resin layer and a polyester elastomer unwoven fabric (produced by Toyobo Co., Ltd., PELPRENE, fabric density of 110 g/cm$^2$) was used as a thermoplastic elastomer layer. The base layer, the thermoplastic resin layer and the thermoplastic elastomer layer were laminated in this order from the front side (the side at which sound wave is radiated). Here, such an unwoven fabric is usually produced by a water jet method.

An opening having approximately 13 cm diameter was formed at the center portion of a stainless steel plate having approximately 16 cm length and 16 cm width to obtain a jig. Two jigs were prepared. The above-mentioned laminate was sandwiched between the two jigs. Then, the laminate was preliminarily heated at 120 to 160° C. for 10 seconds by use of a far infrared heater so that a part of the thermoplastic resin layer (the polyester film) flew into a space of the base layer and the thermoplastic elastomer layer. By performing such a preliminary heating, it is possible to significantly shorten a molding time. Next, the laminate was subjected to molding using a matched die (mold) having a prescribed shape at 130° C. for 30 seconds under pressure of 90 to 140 kg/cm$^2$. After the mold was cooled, the mold was opened so that the molded product was taken out. As a result, a loudspeaker diaphragm having 12 cm diameter and 0.29 mm thickness was obtained.

Figure 8:
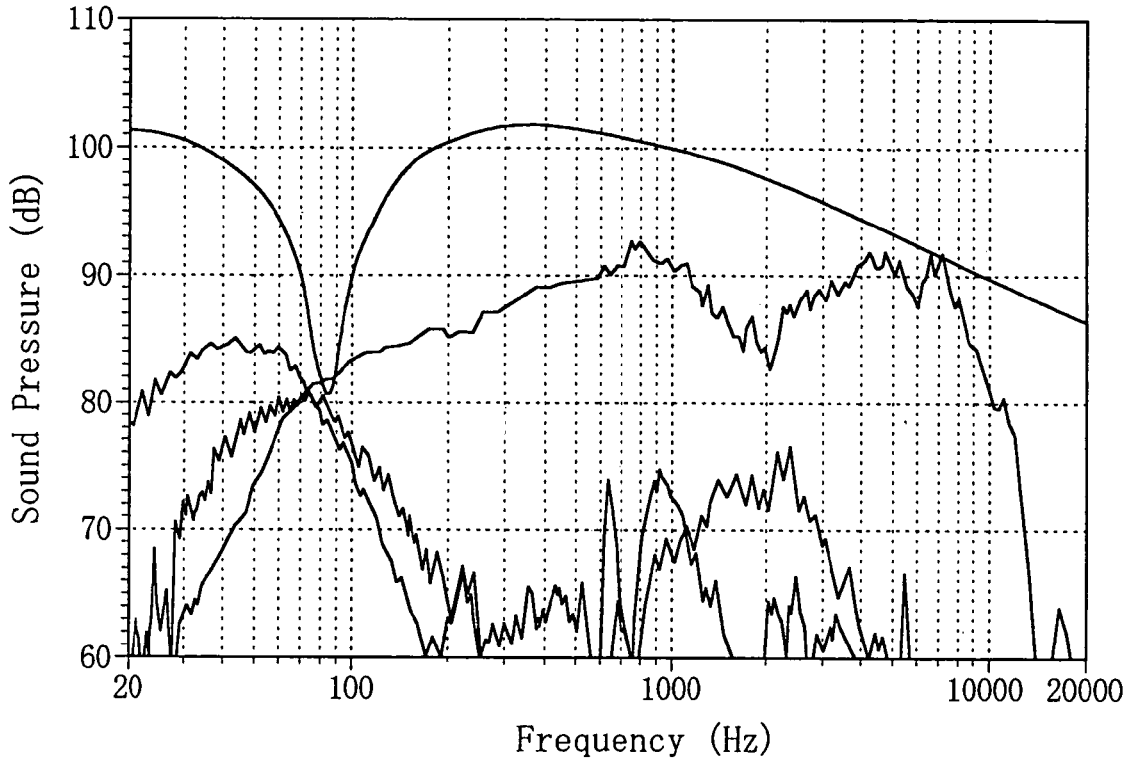
FIG. 8 is a diagram illustrating frequency characteristics of a loudspeaker employing a diaphragm of still another example of the present invention.

Density, weight, Young's modulus and internal loss were measured in accordance with a conventional method with regard to the thus-obtained diaphragm. The results of the measurements together with those of Examples 5 and 6 and Comparative Example 2 (described later) are shown in Table 3 as indicated below. Furthermore, the frequency characteristics of a loudspeaker employing the thus-obtained diaphragm of Example 4 were measured and are shown in FIG. 8.

TABLE 3

| | Density ($g/cm^3$) | Thickness (mm) | Weight (g) | Young modulus ($dyne/cm^2$) | Internal loss (tan δ) |
|---|---|---|---|---|---|
| Example 4 | 1.10 | 0.29 | 2.30 | $2.20 \times 10^{10}$ | 0.45 |
| Comparative Example 2 | 1.40 | 0.29 | 3.20 | $10.44 \times 10^{10}$ | 0.02 |
| Example 5 | 1.10 | 0.29 | 2.30 | $3.40 \times 10^{10}$ | 0.40 |
| Example 6 | 1.10 | 0.29 | 2.30 | $2.20 \times 10^{10}$ | 0.48 |

Comparative Example 2

A prepreg in which a plain woven fabric of KEVLER (trade name, produced by DuPont-Toray Co., Ltd., fineness: 1, 100× 1,100 decitex, 17 warps and 17 wefts per inch, and weave density: 166 $g/m^2$) was impregnated with an epoxy resin was molded at 130° C. for 5 minutes under pressure of 90 to 140 $kg/cm^2$. As a result, a loudspeaker diaphragm having 12 cm diameter and 0.29 mm thickness was obtained.

Figure 9:
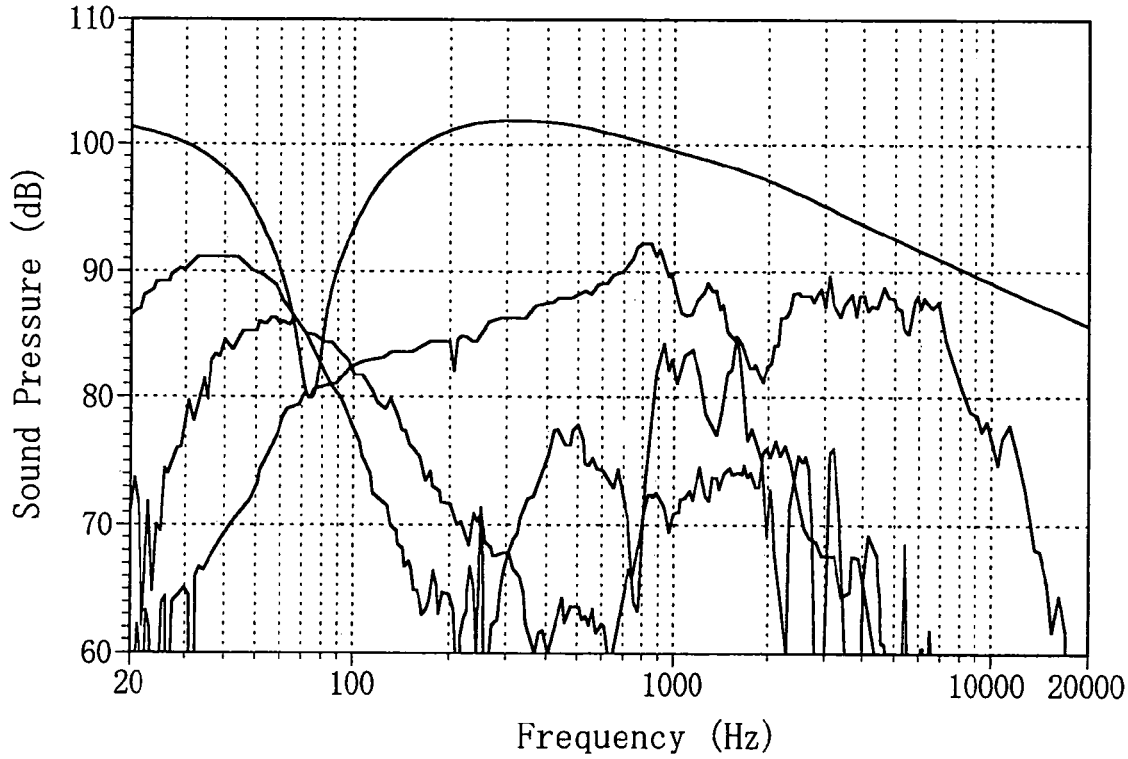
FIG. 9 is a diagram illustrating frequency characteristics of a loudspeaker employing a diaphragm of Comparative Example 2.

The thus-obtained diaphragm was subjected to the same measurement as Example 4. The results are shown in the above-mentioned Table 3. Furthermore the frequency characteristics of a loudspeaker employing the thus-obtained diaphragm of Comparative Example 2 were measured and are shown in FIG. 9.

Example 5

A thermoplastic resin layer having a finely foamed structure was produced by the following process. Polypropylene (produced by Mitsubishi Chemical Corporation, trade name: MA06) was dried by hot air and charged into an extruder whose temperature was controlled at 200° C. so that the polypropylene was molten. Then, carbon dioxide in a pressurized state at 25 MPa was injected by a pump through the middle portion of the extruder. The carbon dioxide was incorporated and dispersed into the molten polypropylene in a short time. The molten mixture was extruded at the die temperature of 140° C. and at an extruding speed of 20 kg/h and was passed through three rolls so as to obtain a foamed sheet. An average diameter of a cell of the foamed sheet was approximately 20 μm.

Figure 10:
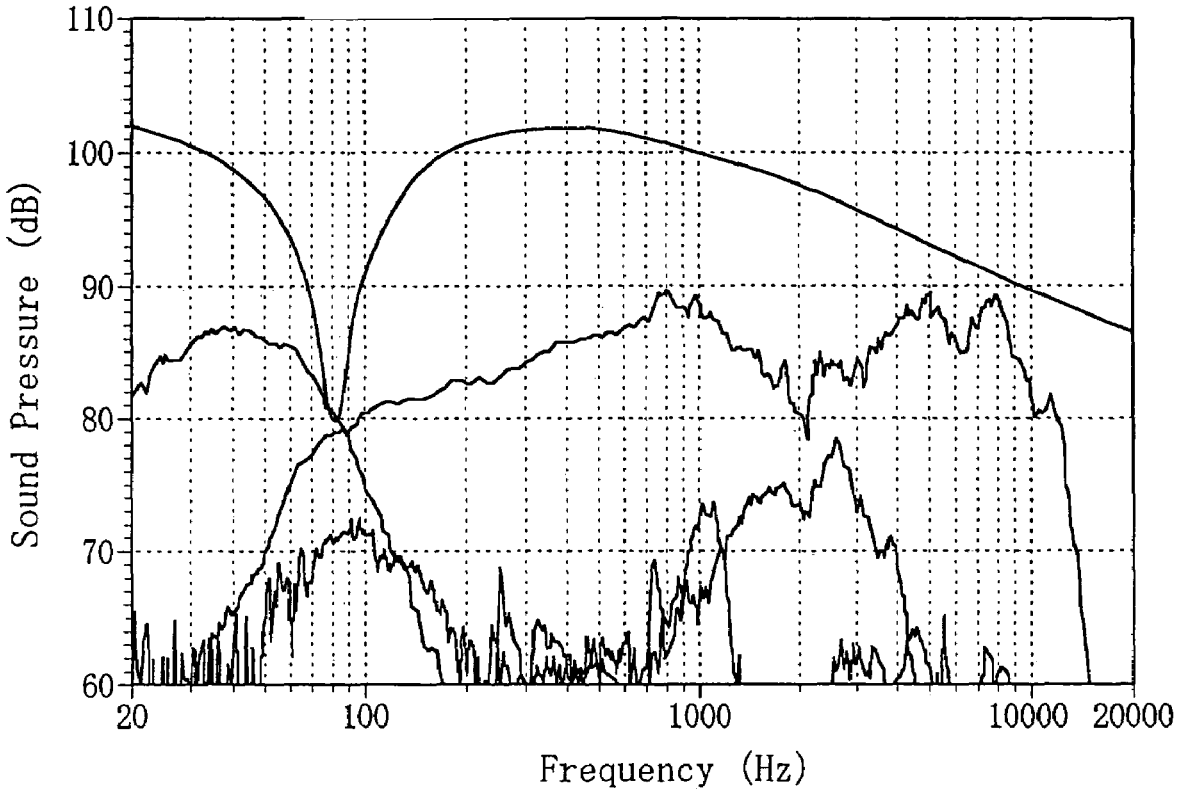
FIG. 10 is a diagram illustrating frequency characteristics of a loudspeaker employing a diaphragm of still another example of the present invention.

A loudspeaker diaphragm was manufactured in the same manner as Example 4 except that the foamed sheet was used as a thermoplastic resin layer. The thus-obtained diaphragm was subjected to the same measurement as Example 4. The results are shown in the above-mentioned Table 3. Furthermore, the frequency characteristics of a loudspeaker employing the thus-obtained diaphragm of Example 5 were measured and are shown in FIG. 10.

Example 6

A loudspeaker diaphragm was manufactured in the same manner as Example 5 except that a base layer, a thermoplastic elastomer layer and a thermoplastic resin layer were laminated in this order from the front side. The thus-obtained diaphragm was subjected to the same measurement as Example 4. The results are shown in the above-mentioned Table 3. Furthermore, frequency characteristics of a loudspeaker employing the thus-obtained diaphragm were measured.

As is apparent from Table 3, loudspeaker diaphragms according to examples of the present invention respectively have low density (light weight) and an excellent balance between Young's modulus (rigidity) and internal loss.

As described above, according to the present invention, it is possible to provide a loudspeaker diaphragm having light weight and an excellent balance between a rigidity and an internal loss by providing a base layer including a woven fabric of a polyethylene naphthalate (PEN) fiber impregnated with a thermosetting resin. Furthermore, according to the present invention, it is possible to provide a simple and inexpensive method for manufacturing such a diaphragm.

Many other modifications will be apparent to and be readily practiced by those skilled in the art without departing from the scope and spirit of the invention. It should therefore be understood that the scope of the appended claims is not intended to be limited by the details of the description but should rather be broadly construed.

What is claimed is:

1. A loudspeaker diaphragm comprising a base layer having a woven fabric of a plurality of polyethylene naphthalate fibers and impregnated with a thermosetting resin, wherein each of the plurality of polyethylene naphthalate fibers is an untwisted fiber, and wherein the loudspeaker diaphragm exhibits an internal loss of 0.40 or more.

2. A loudspeaker diaphragm according to claim 1, wherein the thermosetting resin is an unsaturated polyester resin or a melamine resin.

3. A loudspeaker diaphragm according to claim 1, wherein at least part of at least one of the plurality of polyethylene naphthalate fibers is coated with a second thermosetting resin.

4. A loudspeaker diaphragm according to claim 3, wherein the thermosetting resin is an unsaturated polyester resin and the second thermosetting resin is an epoxy resin or a melamine resin.

5. A loudspeaker diaphragm according to claim 1, wherein a fiber/resin ratio in the base layer is in the range of 60/40 to 80/20 by weight.

6. A loudspeaker diaphragm according to claim 1, further comprising a thermoplastic resin layer.

7. A loudspeaker diaphragm according to claim 6, wherein the thermoplastic resin layer contains at least one selected from the group consisting of nylon, polyester, polyolefin, polystyrene, polyvinyl chloride, polyurethane, polysulfone, polyether ketone, polyether ether ketone, polyacetal, polyalylate, polyamide, polyamideimide, polycarbonate, modified polyphenylene ether, polyphenylene sulfide, polyacrylate, polymethyl methacrylate, polyether imide, polyether sulfone, polytetrafluoroethylene, a liquid crystal polymer and a thermoplastic elastomer.

8. A loudspeaker diaphragm according to claim 1, further comprising a thermoplastic elastomer layer.

9. A loudspeaker diaphragm according to claim 8, wherein the thermoplastic elastomer layer contains at least one selected from the group consisting of a polyester elastomer, a polyurethane elastomer and a polyolefin elastomer.

10. A loudspeaker diaphragm according to claim 6, wherein the thermoplastic resin layer has a finely foamed structure.

11. A loudspeaker diaphragm according to claim 10, wherein an average diameter of a cell in the finely foamed structure is 10 to 60 Φm.

12. A loudspeaker diaphragm according to claim 1, wherein the base layer comprises a woven fabric of cotton or an unwoven fabric of a liquid crystal polymer.

13. A loudspeaker diaphragm according to claim 1, wherein each of the plurality of polyethylene naphthalate fibers is a mono-filament.

14. A loudspeaker comprising a loudspeaker diaphragm having a base layer that has a woven fabric of a plurality of polyethylene naphthalate fibers and impregnated with a thermosetting resin, wherein each of the plurality of polyethylene naphthalate fibers is an untwisted fiber, and wherein the loudspeaker diaphragm exhibits an internal loss of 0.40 or more.

15. A method for manufacturing a loudspeaker diaphragm comprising:

impregnating a woven fabric of a plurality of polyethylene naphthalate fibers with a thermosetting resin and curing the thermosetting resin, so as to form a base layer;

adding inactive gas in a supercritical state to a molten thermoplastic resin and extruding the mixture of the thermoplastic resin and the inactive gas at prescribed temperature and pressure, so as to form a thermoplastic resin layer; and laminating the base layer and the thermoplastic resin layer;

wherein each of the plurality of polyethylene naphthalate fibers is an untwisted fiber, and wherein the loudspeaker diaphragm exhibits an internal loss of 0.40 or more.

16. A method according to claim 15, wherein the inactive gas is selected from the group consisting of nitrogen, carbon dioxide, argon, neon, helium, oxygen and mixed gas thereof.

17. A loudspeaker diaphragm comprising a base layer as the outermost layer, a thermoplastic resin layer and a thermoplastic elastomer layer, wherein the base layer has a woven fabric of a plurality of polyethylene naphthalate fibers and impregnated with a thermosetting resin, wherein each of the plurality of polyethylene naphthalate fibers is an untwisted fiber, and wherein the loudspeaker diaphragm exhibits an internal loss of 0.40 or more.

18. A loudspeaker diaphragm according to claim 17, wherein the thermoplastic resin layer is an intermediate layer composed of a film and the thermoplastic elastomer layer is the innermost layer composed of a woven fabric or an unwoven fabric.

19. A loudspeaker diaphragm according to claim 18, wherein a thermoplastic elastomer constituting the thermoplastic elastomer layer has a melting point higher than that of a thermoplastic resin constituting the thermoplastic resin layer.

* * * * *

UNITED STATES PATENT AND TRADEMARK OFFICE

CERTIFICATE OF CORRECTION

PATENT NO. : 7,631,723 B2
APPLICATION NO. : 10/730162
DATED : December 15, 2009
INVENTOR(S) : Ono et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 555 days.

Signed and Sealed this

Second Day of November, 2010

David J. Kappos

David J. Kappos
*Director of the United States Patent and Trademark Office*